United States Patent [19]

Oswald et al.

[11] Patent Number: 4,482,099

[45] Date of Patent: Nov. 13, 1984

[54] THREAD CATCHER RING

[75] Inventors: Heinz Oswald; Walter Vetterli, both of Winterthur, Switzerland

[73] Assignee: Rieter Machine Works Ltd., Winterthur, Switzerland

[21] Appl. No.: 500,873

[22] Filed: Jun. 3, 1983

[51] Int. Cl.[3] ..... B65H 75/32; B65H 75/28

[52] U.S. Cl. ..... 242/19; 242/18 A; 242/18 PW

[58] Field of Search ..... 242/18 PW, 18 A, 19, 242/25 A, 125, 125.1

[56] References Cited

U.S. PATENT DOCUMENTS

| | | | |
|---|---|---|---|
| 3,801,038 | 4/1974 | Wust | 242/19 |
| 3,809,326 | 5/1974 | Wust | 242/19 |
| 3,856,222 | 12/1974 | Wust | 242/18 A |
| 4,106,711 | 8/1978 | Oswald et al. | 242/19 |

*Primary Examiner*—Stanley N. Gilreath

*Attorney, Agent, or Firm*—Francis C. Hand

[57] ABSTRACT

The thread catching and severing ring structure includes a ring element which is press fit onto a second ring element. The first ring element has a plurality of projections which overlie a groove on the second ring element. The projections and groove are sized so that a thread can be guided into the groove and thereafter into a gap between a land on the second ring element and a projection on the first ring element.

11 Claims, 4 Drawing Figures

THREAD CATCHER RING

Figure 1:
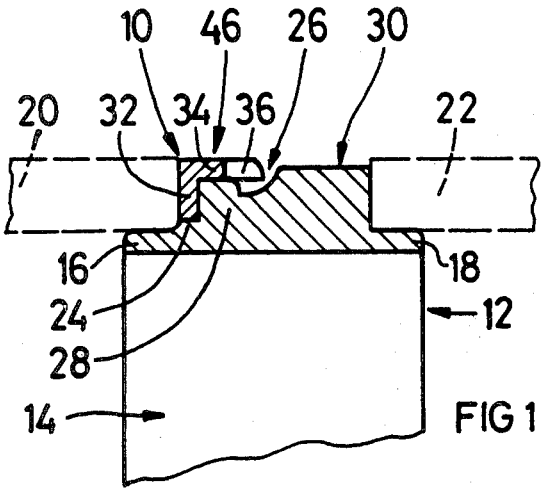

The present application relates to a ring structure for catching and severing a thread on a chuck of a filament winding machine, hereinafter referred to simply as a "ring structure".

Ring structures are now well-known in the filament winding art. An early form of such a structure, and a filament winding machine including such a structure, are shown in British patent specification No. 1332182, correspnding, in part, to U.S. Pat. No. 3,856,222. Further developments of the ring structure are shown in U.S. Pat. Nos. 3,801,038 and 4,106,711. The full disclosures of each of those patent specification is incorporated in the present specification by reference. From British specification No. 1332182 it will be seen that the filament winding machine comprises a rotatable chuck upon which one or more bobbin tubes can be mounted in use. The bobbin tubes are releasably secured to the chuck for rotation therewith so that a package of yarn is formed in use around each rotating bobbin tube. Other filament winding machines using such chuck structures are shown, for example, in U.S. patent specification No. 4,298,171 and U.S. patent application Ser. No. 412,014 filed Aug. 25, 1982.

Most frequently, ring structures have been built into the chuck, e.g. as shown in U.S. Pat. No. 4,106,711 referred to above. However, it has already been suggested that the ring structure can be formed separately from the chuck and can be associated with (preferably secured to) a bobbin tube. In particular, it is known from published Japanese patent applications Nos. 32839 of 1976 and 38544 of 1976 to provide a ring structure which is located in use between two adjacent bobbin tubes on a rotatable chuck and has axial projections which extend into the bores at the adjacent ends of those bobbin tubes.

Ring structures as shown in the prior art referred to above comprise axially projecting teeth having edges for guiding and severing a thread. It is known from U.S. Pat. No. 4,106,711 that a thread can be clamped against the underside (i.e. against a radially inwardly facing surface) of any one of these teeth. In the disclosure of that specification, clamping is effected by a deformable or movable element which moves outwardly against the underside of its associated tooth under the effect of centrifugal force in use, and which returns radially inwardly of the chuck (to release the thread) as the chuck slows down after completion of winding of a thread package. The arrangement described in the U.S. Patent works well and represents the optimum structure for incorporation in the chuck. However, there are circumstances in which that ring structure can be simplified with advantage.

The present invention relates to a thread catching and severing ring structure for use on a chuck of a filament winding machine. The ring structure comprises at least one axially directed projection having an underside facing radially inwardly and a thread guiding and severing edge. The ring structure further comprises a clamp member secured in engagement with the underside of the projection to form a thread clamp therebetween. The ring structure further comprises a guide surface sloping radially inwardly towards and under the projection, and then sloping radially outwardly towards the underside of the projection to guide a thread into the clamp.

Normally, the ring structure comprises a plurality of projections angularly spaced around the ring structure, and a clamp member may then extend continuously around the ring structure, engaging the underside of each projection. There could, however, be individual clamp members associated with respective projections. The guide surface may also extend continuously around the ring structure, or there may be a plurality of guide surfaces associated with respective projections.

The projection or projections may be formed on a first ring element, the clamp member or clamp members on a second ring element and the ring elements may be secured together to form the ring structure. This may be effected by passing a portion of one ring element into a receiving bore in the other ring element, the receiving bore preferably being provided on the first ring element. The second ring element is also preferably provided with the guide surface.

The clamp member may be rigid, e.g. being made of a rigid plastics material.

The ring structure may have means for connecting it to a bobbin tube, e.g. a tubular portion adapted to project into the bore of a bobbin tube. In a preferred embodiment, the ring structure is provided with two such means for cooperation with respective ends of adjacent, axially aligned bobbin tubes.

The ring structure may have a bore arranged to be free sliding fit on the external surface of a chuck of a filament winding machine. The bore of the ring structure may, however, be provided with means for cooperation with a locating device provided in the chuck. The ring structure can then, for example, provide axial location for one or more bobbin tubes mounted on the chuck in use.

Figure 1A:
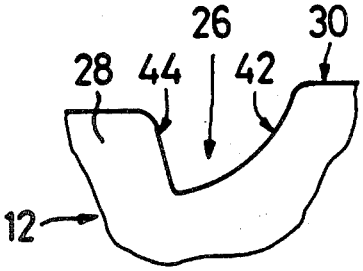
Figure 2:
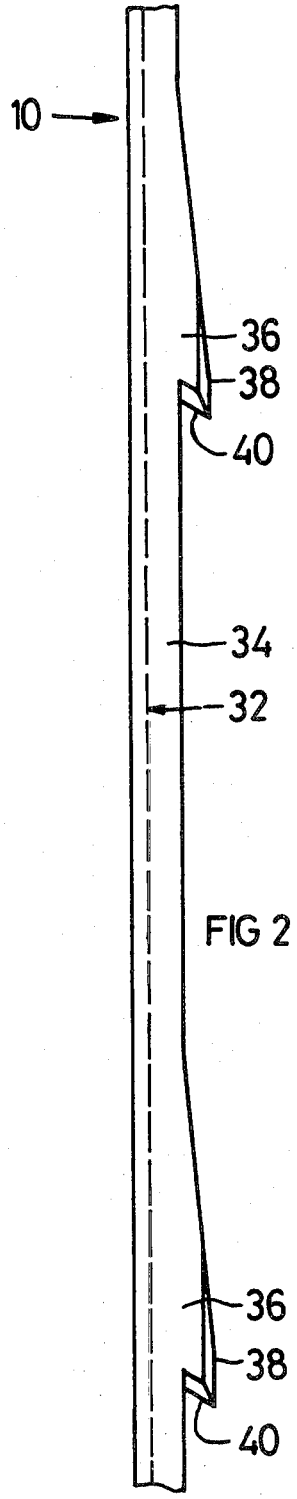
Figure 3:
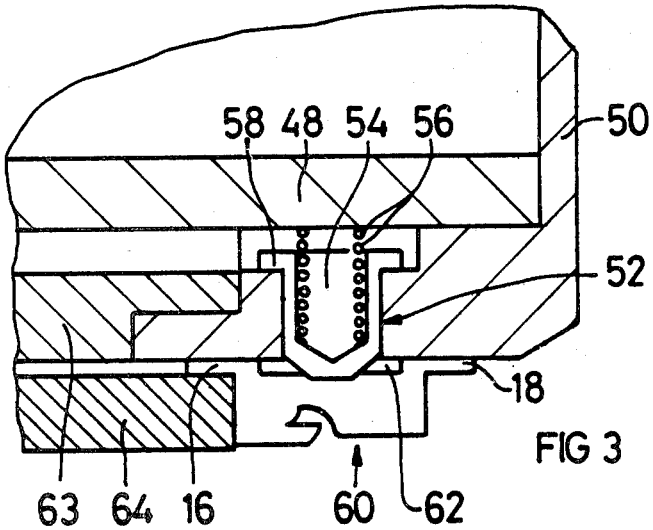

By way of example, one embodiment of the invention and some variations thereof will now be described with reference to the accompanying drawings, in which FIG. 1 shows an axial section through part of a ring structure according to the invention, FIG. 1A being a detail therefrom drawn to a larger scale, FIG. 2 shows a developed view of one of the ring elements shown in FIG. 1, and FIG. 3 is a diagrammatic section through an end portion of the chuck showing use of a ring structure according to the invention as a locating element.

The ring structure shown in FIG. 1 comprises a first ring element 10 and second ring element 12. Each ring element is in itself an integral body, the two elements being secured together as will be described below in order to form the complete ring structure.

The cross section of ring element 12 is uniform around the whole periphery of the structure. The internal surface 14 of element 12 is a smooth cylinder, which is dimensioned to provide a free sliding fit on the external surface of a chuck with which the ring structure is intended to be used. At each axial end, element 12 has tubular portions 16 and 18 respectively the external surfaces of which are dimensioned to fit within the bores of adjacent axially aligned bobbin tubes indicated by dotted lines at 20 and 22 respectively.

Immediately adjacent tubular portion 16, element 12 has a low, outwardly extending step 24, the annular, outwardly facing surface of which provides a receiving surface for the element 10 as will be further described below. The portion of element 12 between step 24 and tubular portion 18 is of relatively large radial depth and has in its outwardly facing surface a groove 26 so that a land 28 is left between the groove 26 and step 24. Between groove 26 and the tubular portion 18, element 12 has a cylindrical outwardly facing surface 30.

As can be seen from FIGS. 1 and 2 taken together, ring element 10 is of L-shaped cross section, with a longer leg 32 of the L engaging an axially facing surface on the land 28, and a shorter leg 34 of the L overlying the radially outwardly facing surface of the land. Leg 34 is so short that it does not extend into the groove 26. However, as best seen in FIG. 2, leg 34 has a plurality (preferably 4) axially directed projections 36 the axially outermost portions of which lie over the groove 26. Each projection 36 is of limited angular extent, and the projections are equi-angularly spaced around the periphery of element 10. Each projection 36 is shaped with edges 38, 40 which meet at a point. Similar edges, which are designed for guiding and severing a thread, have been shown and described in the prior U.S. Pat. Nos. 3,801,038 and 4,106,711 referred to above, and accordingly no detailed description of these edges is included in this specification.

The elements 10 and 12 fit together with the free end of the longer leg 32 engaging the outwardly facing surface on step 24 and with the outwardly facing surface of the land 28 engaging the underside (i.e. the radially inwardly facing surface) on the leg 34 and its projections 36. The dimensions are, however, such that a thread can penetrate into the gap between land 28 and a projection (hereinafter referred to as a "tooth") 36, so that a thread clamp is formed between the land 28 and each tooth 36. Element 10 is a simple press fit on element 12. There is no need to use additional securing means, e.g. an adhesive or one or more fixing screws through the leg 34. A permanent connection between the ring elements is in any event preferably avoided since it may be necessary to disassemble the ring structure to release thread caught in the clamp.

As best seen in the enlargement in FIG. 1A, groove 26 has a first surface 42 facing the teeth 36 and sloping radially inwardly from the surface 30 on element 12. The other side of the groove is formed by second surface 44 sloping radially outwardly from the trough of the groove 36 to join the radially outwardly facing (clamping) surface of the land 28. The axial distance between the longer leg 32 of the element 10 and the apex of each tooth 36 thereupon is such that the tooth apex is spaced slightly from the surface 42 when the ring structure is assembled (FIG. 1). Thus a thread on the surface 42 can slide down that surface to a position radially inwardly of (below) a tooth. The thread can then slide radially outwardly (upwardly) along surface 44 into the clamp between land 28 and tooth 36. The inclination of surface 44 relative to the axis of the ring structure is steep in comparison with the corresponding inclination of the surface 42. The trough of the groove 26 therefore lies adjacent to the root of each tooth 36 as viewed in plan (FIG. 2).

The dimensions of the element 10 are chosen so that the radially outwardly facing surface 46 on that element is spaced radially outwardly from the surface 30 (see FIG. 1). In use, a filament is laid upon the surface 30 and is moved axially of the ring structure towards the left as viewed in FIG. 1. Suitable means for causing this axial movement of the filament are well-known in the art (see e.g. GB Pat. No. 1520643) and will not be described in this specification. When the filament reaches the groove 26, it slides down the surface 42, up the surface 44 and into the clamp as described above. If the filament should tend to follow a path forming a simple axial extension of the surface 30, then the filament will engage the adjacent end face of a tooth 36 and will be directed thereby back into the groove 26.

FIG. 3 shows a slight modification of the device shown in FIGS. 1 and 2. Details of the device have been omitted so that only the differences over the device of FIG. 1 are apparent from FIG. 3. Thus it will be understood that the device of FIG. 3 is also a two-part structure having teeth and a guide groove as described with reference to the other figures.

FIG. 3 shows part of a chuck structure including an inner shell 48 and an end cap 50 at the free end of the cantilevered chuck. End cap 50 is suitably secured to the shell 48 by means not shown. Cap 50 has an opening 52 receiving a detent element 54 which is biased radially outwardly by a spring 56 and is retained in the end cap by a flange 58. The tip of detent element 54 projects radially outwardly from the cylindrical outer surface of the cap 50.

The ring or device 60 shown in FIG. 3 differs from that shown in FIGS. 1 and 2 in that it has a groove 62 in its internal bore to receive the tip of the detent element 54. The un-grooved portion of the bore of device 60 is arranged to be a sliding fit on the cylindrical surface of the end cap 50. The latter surface is aligned in the complete chuck structure with the outer surface of a protective shell 63 and the bores of the other ring structures slide freely of the outer surface of that shell.

Numeral 64 indicates an end portion of a bobbin tube which receives the tubular portion 16 of the device 60. The end face of the bobbin tube 64 is located against the longer leg of the ring element 10 in the device 60. Thus, device 60 in cooperation with the detent 54 acts as an axial locating mechanism for the bobbin tube 64. Device 60 is also illustrated with a tubular portion 18, similar to the devices shown in FIGS. 1 and 2. This is, of course, not necessary for a ring structure cooperating with an end cap, since there will be no bobbin tube to the right of the tube 64 shown in FIG. 3. There may, however, be further bobbin tubes on the same chuck to the left of the tube 64 shown in FIG. 3, in which case each pair of adjacent tubes is joined into a composite tube structure for mounting on the chuck by means of the tubular portions 16, 18 on a ring structure provided between the adjacent tube ends of the pair.

Element 12 is preferably formed from a plastics material, while ring element 10 is preferably formed from metal to facilitate accurate formation of the teeth 36.

The invention is not limited to the details of the illustrated embodiments. The exact form of the teeth does not form part of the present invention and can be adapted to operating circumstances as required. The ring structure is preferably made as a two-part structure as shown, but could be assembled from more parts if required. The clamp member (the land 28 in the illustrated embodiment) is preferably rigid, but could be made from a deformable material if required. In any event, the clamp member is in continuous engagement with the underside of each tooth 36, even when a chuck carrying the ring is not in rotation, i.e. when no centrifugal force is acting upon the clamp member.

The clamp member has been described as a continuous land extending around the periphery of ring element 12. There could, however, be individual clamp members associated with the respective teeth 36. Similarly, the groove 26, with its guide surfaces 42, 44, has been described as continuous extending around the periphery of ring element 12, whereas there could be a plurality of individual recesses in the element 12, the recesses being associated with a respective tooth and providing the required guide surfaces leading thereto.

The ring structure illustrated and described is intended for use between adjacent bobbin tubes on the exterior of a chuck. The ring structure could be built into the chuck structure itself. However, in view of the risk of retention of a thread end in the thread clamp, it will normally be preferable to remove each ring structure from its associated chuck with the completed yarn packages, and to separate the ring structures from the bobbin tubes subsequent to this doffing step. The thread end can remain clamped in the ring structure until this separation step.

We claim:

1. A thread catching and severing ring structure for use on a chuck of a filament winding machine comprising at least one axially directed projection having an underside facing radially inwardly and a thread guiding and severing edge, a clamp member secured in engagement with said underside of said projection to form a thread clamp therebetween and a guide surface sloping radially inwardly towards and under said projection and then radially outwardly towards said underside of said projection to guide a thread into said clamp.

2. A ring structure as claimed in claim 1 and comprising a plurality of projections, said clamp member extending continuously around the ring structure and engaging the underside of each projection.

3. A ring stucture as claimed in claim 2 wherein said guide surface also extends continuously around the ring structure.

4. A ring structure as claimed in claim 2 or claim 3 wherein said projections are provided on a first ring element, said clamp member is provided on a second ring element and the ring elements are secured together to form the ring structure.

5. A ring structure as claimed in claim 4 wherein said second ring element also provides said guide surface.

6. A ring structure as claimed in claim 4 wherein said first ring element has an internal bore and said second ring element has a portion received within said bore in order to secure said elements together.

7. A ring structure as claimed in claim 6 wherein said second ring element has a groove providing said guide surface and a land between said groove and said portion received within the first ring element, the projections overlying said land which provides said clamp member.

8. A ring structure as claimed in claim 1 wherein said clamp member is rigid.

9. A ring structure as claimed in claim 1 and comprising means cooperable with an end portion of a bobbin tube to secure the ring structure to the bobbin tube.

10. A ring structure as claimed in claim 9 wherein the means is one of two such means cooperable respectively with adjacent end portions of axially aligned bobbin tubes to connect the tubes to the ring structure and thereby to each other.

11. A chuck for use in winding filament into packages in combination with a ring structure as claimed in claim 1, and inter-engaging means between the chuck and the ring structure to locate the ring structure axially of the chuck.

* * * * *

UNITED STATES PATENT AND TRADEMARK OFFICE

CERTIFICATE OF CORRECTION

PATENT NO. : 4,482,099

DATED : November 13, 1984

INVENTOR(S) : Heinz Oswald and Walter Vetterli

It is certified that error appears in the above-identified patent and that said Letters Patent is hereby corrected as shown below:

| Column | Line | From | To |
|---|---|---|---|
| 1 | 12 | "correspnding" | -- corresponding-- |
| 4 | 20 | after "ring" insert | -- structure -- |

Signed and Sealed this

*Ninth* Day of *April 1985*

[SEAL]

*Attest:*

DONALD J. QUIGG

*Attesting Officer* *Acting Commissioner of Patents and Trademarks*